US005371486A

United States Patent [19]

Yamada et al.

[11] Patent Number: 5,371,486

[45] Date of Patent: Dec. 6, 1994

[54] TRANSFORMER CORE

[75] Inventors: Kazuo Yamada, Tsu; Eiji Shimomura, Yokkaichi; Kenshi Ishihara, Mie; Miyoshi Horiuchi, Suzuka, all of Japan

[73] Assignee: Kabushiki Kaisha Toshiba, Kanagawa, Japan

[21] Appl. No.: 982,258

[22] Filed: Nov. 25, 1992

Related U.S. Application Data

[63] Continuation of Ser. No. 687,399, Apr. 18, 1991, abandoned.

[30] Foreign Application Priority Data

Sep. 7, 1990 [JP] Japan ..... 2-235692
Jan. 25, 1991 [JP] Japan ..... 3-007980

[51] Int. Cl.[5] ..... H01F 27/24

[52] U.S. Cl. ..... 336/212; 336/217; 336/218; 336/234

[58] Field of Search ..... 336/212, 218, 233, 234, 336/216, 217

[56] References Cited

U.S. PATENT DOCUMENTS 2,088,440 7/1937 Ruder ..... 336/218
2,465,798 3/1949 Granfield ..... 336/218
3,290,633 12/1966 Kuriyama et al. ..... 336/218
4,205,288 5/1980 Lin et al. ..... 336/212

FOREIGN PATENT DOCUMENTS 693288 6/1953 United Kingdom ..... 336/218

OTHER PUBLICATIONS

"Application of 6.5% Si Steel Sheets to Audio Frequency Transformers," by Yasushi Tanaka et al., NKK Technical Report No. 131 (1990), pp. 1–8.

Development of Fe–6.5 wt. % Si Sheet in Commercial Scale Production, Y. Takada, M. Abe Fujita, MRS International Meeting on Adv. Mats. vol. 11 (1989).

*Primary Examiner*—Thomas J. Kozma
*Attorney, Agent, or Firm*—Limbach & Limbach

[57] ABSTRACT

A transformer core includes a first core member formed by laminating grain oriented 3% silicon steel sheets and second core members disposed at respective sides of the first core member in the direction of lamination so that the first core member is sandwiched by the second core members. Each second core member is formed by laminating non-oriented 6.5% silicon steel sheets. A commercial frequency component of magnetic fluxes mainly passes through the second core members such that an amount of noise caused by a higher harmonic component is reduced.

1 Claim, 7 Drawing Sheets

TRANSFORMER CORE

This is a continuation of co-pending application Ser. No. 07/687,399, now abandoned, filed on Apr. 18, 1991.

BACKGROUND OF THE INVENTION

This invention relates generally to a magnetic core of a transformer employed in inverters serving as a power supply system, and more particularly to such a transformer core wherein noise due to magnetostrictive vibration is reduced without worsening magnetic properties of the core.

Latest progress in electronic technology has found use of an increasing number of equipments each employing an inverter as a power supply system, for example, uninterruptive power supply units, vehicle transformers or rectifier transformers. In transformers employed in the inverters as the power supply system or rectifying transformers, an output voltage contains not only a fundamental wave component at the frequency of 50 or 60 Hz but a higher harmonic component in the frequency range between several 100 Hz and several 10 KHz. Noise due to the higher harmonic component is a critical problem. More specifically, noise in induction equipments results from magnetostrictive vibration in magnetic cores. The noise due to the magnetostrictive vibration is influenced by a power supply frequency. The noise is increased when the power supply frequency contains the higher harmonic component, which noise is offensive to the ears of persons. Accordingly, the induction equipments raise a problem of noise. Since some induction equipments, particularly, the uninterruptive power supply system are installed indoors, it is desirable that the noise be reduced in the induction equipments.

Conventionally, the transformer of the inverter employed as the power supply system or that of the rectifier includes a cut core formed by winding a number of grain-oriented 3% silicon steel sheets or a laminated core formed by laminating a number of grain-oriented 3% silicon steel sheets and a coil combined with either core.

However, the magnetostriction of the grain-oriented steel sheets employed in the above-described transformers takes a large value of $2\times10^{-6}$ in the range of an operating magnetic flux density and accordingly, the higher harmonics due to on-off operation of a switching element forming a main circuit of the inverter increase the noise.

It has been proposed that 6.5% silicon steel sheets be employed to form the cores of the induction equipments such as the transformer, instead of the conventional 3% silicon steel sheets. The 6% silicon steel sheet has a low level of magnetostriction and superior magnetic properties. The 3% silicon steel sheet will hereinafter be referred to as "low content type silicon steel sheet" and the 6% silicon steel sheet as "high content type silicon steel sheet."

It has been known in the art that the level of the magnetostriction is nearly zero and the iron loss is reduced in the 6.5% silicon steel sheet. On the other hand, since the silicon steel sheet becomes fragile as the content of silicon is increased, it has been considered difficult to produce the silicon steel sheets by way of rolling. Recently, however, the 6.5% silicon steel sheets have been developed as the result of improvement in the technique for rolling fragile materials and development in the gaseous phase vapor deposition technique.

The 6.5% silicon steel sheet is a material advantageous in the noise reduction in the induction equipments since the magnetostriction thereof is an approximate value of $0.3\times10^{-6}$. However, an exciting current is disadvantageously increased in equipments of commercial frequencies since the saturation value of the magnetic flux density is small in the low frequency range in the level of 50 to 60 Hz and the B–H (flux density vs. magnetizing force) characteristic is low in high flux density ranges. Accordingly, the magnetic flux density needs to be reduced when the 6.5% silicon steel sheets are employed in the equipments operated at the commercial frequencies but the reduction in the magnetic flux density renders the core large-sized, which prevents the equipments from being small-sized and lightweight. On the other hand, the B–H characteristic of the 6.5% silicon steel sheet in the magnetic high flux density range can be improved by setting the annealing temperature to a low value in the production of the 6.5% silicon steel sheets. In this case, however, the iron loss is increased.

SUMMARY OF THE INVENTION

Therefore, an object of the present invention is to provide an improved transformer core wherein the noise due to the magnetostrictive vibration can be reduced without worsening the magnetic properties resulting in increase in the iron loss and exciting capacity.

The present invention provides a distorted wave AC transformer core comprising a first core member formed by laminating a number of grain-oriented silicon steel sheets and a pair of second core members disposed at opposite sides of the first core member in a direction that a lamination of the grain-oriented silicon steel sheets of the first core member extends, each second core member being formed of a material having magnetostriction lower than the first core member, the pair of second core members having an overall sectional area, taken in a direction perpendicular to a direction in which magnetic fluxes pass through the second core members, in the range of 10 to 50% of an overall sectional area of the first and second core members.

FIGS. 5 and 6 show iron loss and excitation capacity characteristics of the above-described first and second core members having different silicon content ratios. As obvious from the figures, the iron loss and excitation capacity of the second core member are larger than those of the first core member at the frequency of 50 Hz. Particularly, the excitation capacity of the second core member is rapidly increased in the range of the magnetic flux density exceeding 1.0 (T). However, the difference between the characteristics of the first and second core members is reduced with increase in the frequency and the characteristics are approximately equal at the frequency of 400 Hz. At further higher frequencies, the iron loss and excitation capacity of the second core member are lower than those of the first core member. The reason for this is that an eddy current loss is reduced and a magnetic permeability is increased in the high frequency ranges since the specific resistance of the 6.5% silicon steel sheet is larger than that of the grain-oriented silicon steel sheet.

The transformer core comprising the above-described first and second core members shows an approximately average characteristic of those of the core members.

The noise produced from the second core member is reduced over the whole frequency range as compared with the noise from the first core member, as shown in FIG. 7. The difference between the levels of noise produced from the first and second core members is increased with increase in the frequency.

Accordingly, when the transformer core of the present invention is applied to, for example, the transformer of the inverter as the power supply system wherein the magnetic flux contains the fundamental wave component at the frequency of 50 or 60 Hz and the higher harmonic component in the frequency range of several kilo hertz, most of the fundamental wave component is concentrated on the grain-oriented silicon steel sheets while the higher harmonic component is concentrated on the low magnetostrictive materials. Consequently, the noise can be reduced to a large extent without worsening the magnetic properties.

Other objects of the present invention will become obvious upon understanding of the illustrative embodiments about to be described. Various advantages not referred to herein will occur to one skilled in the art upon employment of the invention in practice.

DESCRIPTION OF THE PREFERRED EMBODIMENT

Figure 3:
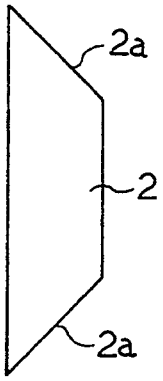
FIG. 3 is a top plan view of a steel sheet forming a first core member of the transformer core.

A first embodiment of the present invention will be described with reference to FIGS. 1 to 4. A first core member 1 is formed by laminating a number of grain oriented 3% silicon steel sheets 2. Each silicon steel sheet 2 is formed into a generally trapezoidal shape with both ends 2*a* cut at 45 degrees in opposite directions, as shown in FIG. 3. The ends of four silicon steel sheets 2 are butted against one another so that a magnetic closed loop is formed such that a generally rectangular frame-like first core member 1 is formed.

Figure 1:
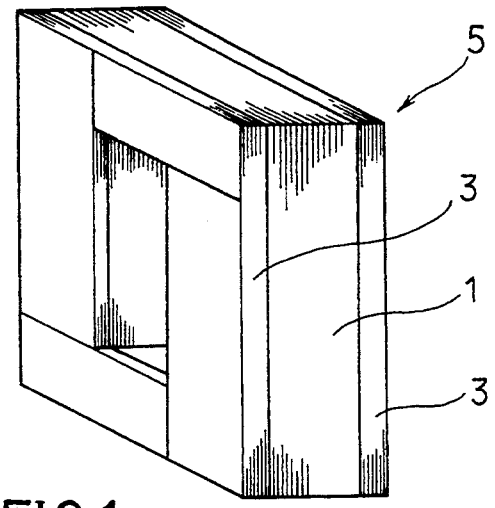
FIG. 1 is a perspective view of a transformer core of a first embodiment in accordance with the present invention.
Figure 2:
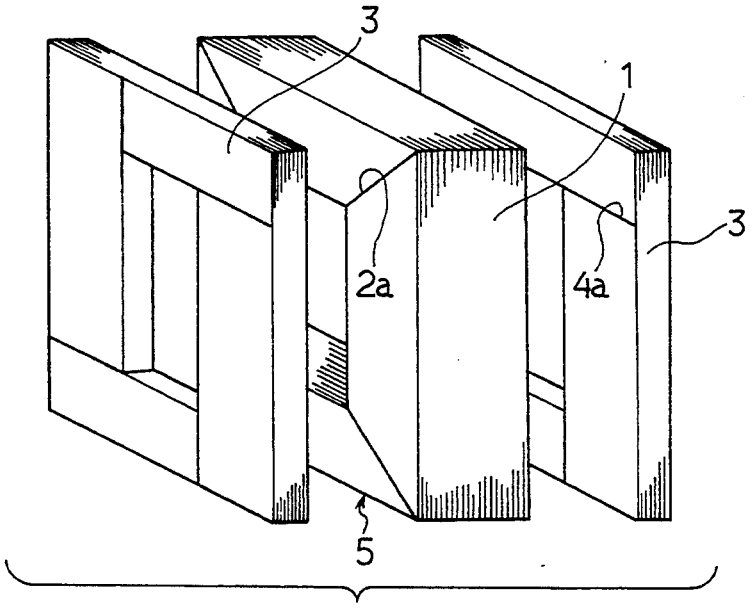
FIG. 2 is an exploded perspective view of the transformer core in FIG. 1.
Figure 4:
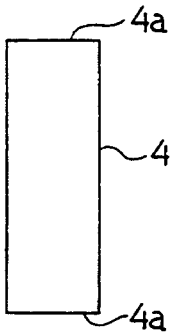
FIG. 4 is a top plan view of a steel sheet forming a second core member of the transformer core.

Each second core member 3 is formed by laminating a number of non-oriented 6.5 silicon steel sheets 4. Each silicon steel sheet 4 has both ends 4*a* cut perpendicularly, as shown in FIG. 4. A side edge portion of each silicon steel sheet 4 is butted against one end 4*a* of each silicon steel sheet 4 such that a magnetic closed loop is formed. Thus, a generally rectangular frame-like second core member 3 is formed. The second core members 3 are disposed at opposite sides of the first core member 1 in a direction that a lamination of the silicon steel sheets 2 of the first core member 1 extends, such that a core assembly 5 as shown in FIG. 1 is formed. In the core assembly 5, the ratio $S_1/S_2$ is set to the range between 10 and 50% where symbol $S_1$ refers to the gross cross-sectional area of a pair of second core members 3 in the direction perpendicular to the direction in which magnetic fluxes pass through the pair of second core members 3 and symbol $S_2$ the gross cross-sectional area of the core assembly 5 in the direction perpendicular to the direction in which the magnetic fluxes pass through the core assembly 5. The core assembly 5 is surrounded by one or more windings in the same manner as in the prior art and a resultant core and winding assembly is used as a transformer for an inverter serving as a power supply system.

In the core assembly 5 constructed as described above, the ratio of the first core member 1 formed of the low content type silicon steel sheets 2 to the gross cross-sectional area of the core assembly 5 ranges between 50% and 90%. Accordingly, a disadvantage of the second core member 3 formed of a low magnetostrictive material such as high content type silicon steel sheets, that is, the B–H characteristic in the high magnetic flux density range at the commercial frequencies can be prevented from being reduced. Furthermore, the iron loss is less in the core assembly 5 than in a core assembly formed only by high content type silicon steel sheets. The reason for this is that most of the magnetic fluxes are caused to flow through the first core member 1 having high magnetic permeability in the range of the commercial frequency by combining the first and second core members 1, 3 at a suitable ratio.

On the other hand, regarding the higher harmonic component (about 2 to 5 KHz) contained in the inverter main circuit current, most of the higher harmonic component of the magnetic fluxes is caused to flow through the second core member 3 having high magnetic permeability in the high frequency range, which means that the core assembly 5 has superior magnetic properties when employed in the transformer for the inverter serving as a power supply system.

Regarding the noise, the magnetostriction of the 6.5% silicon steel sheet is approximately $0.3\times10^{-6}$, which value is about one tenth of the magnetostriction of the grain oriented 3% silicon steel sheet which is approximately $2\times10^{-6}$. Thus, the magnetostriction of the 6.5% silicon steel sheet is small as compared with that of the grain oriented 3% silicon steel sheet.

TABLE 1 shows noise characteristics of the transformer of the inverter serving as a power supply system.

TABLE 1

| Core construction | Noise (dB) Magnetic flux 1.0 T | 1.2 T | 1.5 T |
|---|---|---|---|
| Ratio of second core member cross sectional area to whole core assembly cross sectional area, $S_1/S_2$ | | | |
| 5 | 51 | 59 | 69 |
| 10 | 47 | 56 | 65 |
| 30 | 45 | 54 | 63 |
| 50 | 44 | 53 | 62 |
| Only 6.5% silicon steel sheets | 43 | 53 | — |
| Only grain-oriented 3% silicon steel sheets | 52 | 60 | 70 |

As obvious from TABLE 1, the noise is reduced 5 to 8 dB at the flux density of 1.5 T in the case of the core assembly 5 of the present embodiment as compared with a core formed of only conventional grain oriented 3% silicon steel sheets. On the other hand, the noise is not so much reduced in the case where the ratio $S_1/S_2$ is 5%. The noise level in the case where the ratio $S_1/S_2$ is 50% is approximately same as that in the case where the core is composed only of 6.5% silicon steel sheets. Thus, even when the component ratio of the 6.5% silicon steel sheet to the whole core is increased more than 50%, further increase in the noise reduction effect cannot be expected and on the contrary, the magnetic properties such as the iron loss, excitation current and the like are reduced. Therefore, it is not preferable to increase the component ratio of the 6.5% silicon steel sheet to the whole core more than 50%.

The second core members 3 each comprising the 6.5% silicon steel sheets 4 are disposed at the opposite sides of the first core member 1 comprising the grain oriented 3% silicon steel sheets 2, in the direction of lamination of the steel sheets, as described above. The reason for this is that good noise reduction effect can be achieved by disposing the second core member 3 with an exceedingly low level of noise due to magnetostriction at the opposite sides of the first core member 1 in the direction of lamination of the silicon steel sheets in expectation of a noise screening effect, each of which sides of the first core member having a large radiation surface for noise emanation.

Although the first core member 1 is formed by laminating the elongated trapezoidal steel sheets in the foregoing embodiment, it may be formed by laminating rectangular steel sheets, as shown in FIG. 4.

Figure 8:
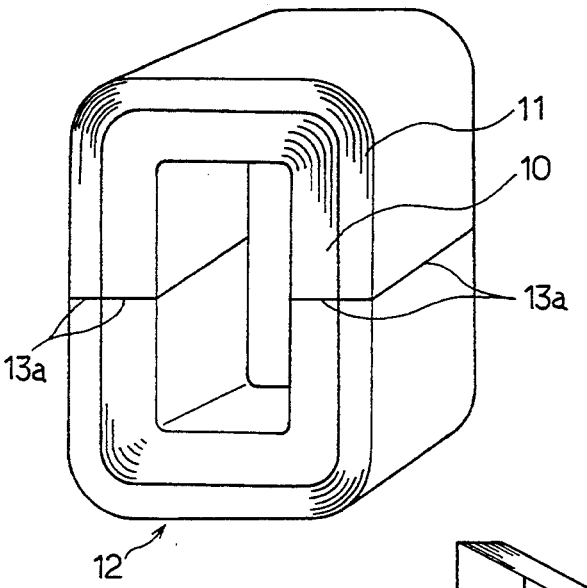
FIG. 8 is a perspective view of a transformer core of a second embodiment in accordance with the present invention.

FIG. 8 illustrates a second embodiment of the invention. The first core member 10 is formed by winding band-shaped grain oriented 3% silicon steel sheets into a generally wound core. The second core member 11 is formed by winding band-shaped 6.5% silicon steel sheets around the outer periphery of the first core member 10 into a wound core. The core assembly 12 comprising the first and second core members 10, 11 is cut at two portions shown by numerals 13*a* in FIG. 8 after the steel sheets of the respective core members are wound such that the core assembly 12 has the construction of a generally C-shaped core which can be combined with coils. The cross sectional area of the second core member 11 is set to the value ranging 10 to 50% of the cross sectional area of the core assembly 12.

In spite of the fact that the 6.5% silicon steel sheet is so fragile that it cannot be wound at a too acute curvature, winding the silicon steel sheets into the second core member 11 can be readily performed since the curvature at each corner portion is increased by the first core member 10 disposed inside the second core member 11.

The first and second core members 10, 11 may be obtained by winding the steel strips individually to form individual wound cores and then, combining both wound cores in a concentric relation as shown in FIG. 8. Furthermore, each steel strip may be cut into pieces every one turn and a number of such pieces may be laminated to obtain the construction shown in FIG. 8.

Figure 9:
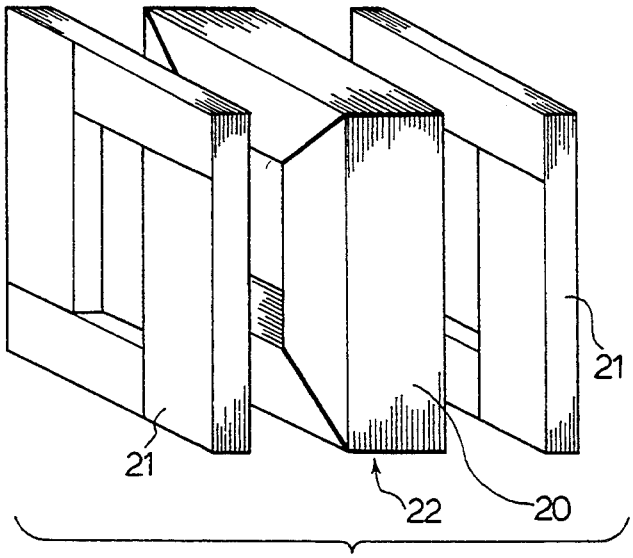
FIG. 9 is an exploded perspective view of a transformer core of a third embodiment.
Figure 10:
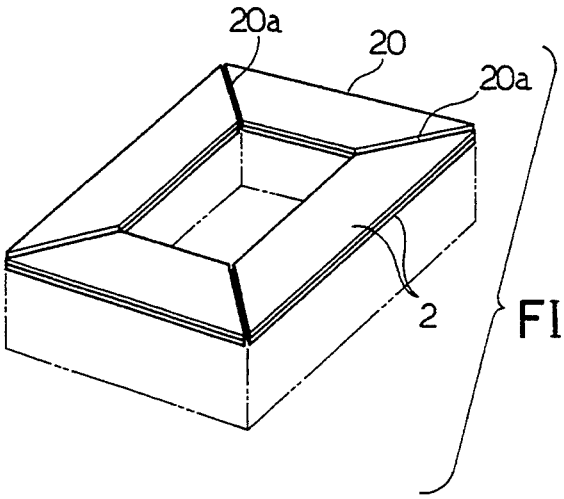
FIG. 10 is a perspective view of the transformer core in FIG. 9 for explaining lamination of the steel sheets.

FIGS. 9 and 10 illustrate a third embodiment of the invention. The core assembly 22 in this embodiment comprises the first core member 20 formed by laminating the grain oriented 3% silicon steel sheets 2 as shown in FIG. 3 and a pair of second core members 21 each formed by laminating the non-oriented 6.5% silicon steel sheets as shown in FIG. 4. In this embodiment, particularly, a predetermined number of steel sheets 2, for example, three steel sheets are laminated with a gap 20*a* of 1 to 3 millimeters wide (about 2 millimeters wide, in the embodiment) formed between each end 2*a* of each steel sheet 2 cut at 45 degrees and one such end 2*a* of each neighboring steel sheet 2. Thereafter, each gap 20*a* is filled in with an adhesive containing a magnetic powder such as iron powder such that each steel sheet 2 is joined to the neighboring steel sheets 2, thereby obtaining a unit sheet comprising three laminated steel sheets 2. A predetermined number of such unit sheets are stacked together to thereby obtain the first core member 20. In the first core member 20 formed as described above, the magnetic resistance at each junction depends at least upon dimensions of each gap 20*a* and an amount of magnetic powder contained in the adhesive, denoting a larger value as compared with a case where no gap is provided.

In the second core member 21, each end 4*a* of each laminated steel sheet 4 is butted against each end 4*a* of each neighboring steel sheet 4 without gap. The cross sectional area ratio $S_1/S_2$ is set to 50% in the core assembly 22.

In accordance with the core assembly 22, the magnetic resistance of the first core member 22 is increased in the commercial frequency range as the result of the presence of each gap 20*a* at each junction of each end of each steel sheet and each end of each neighboring steel sheet. Accordingly, it should be noted that an amount of magnetic flux of the commercial frequency component diverted to the second core member 21 comprising the 6.5% silicon steel sheets 4 is increased with increase in the magnetic resistance of the first core member 22, each 6.5% silicon steel sheet 4 having low magnetic permeability relative to low frequency.

Figure 5:
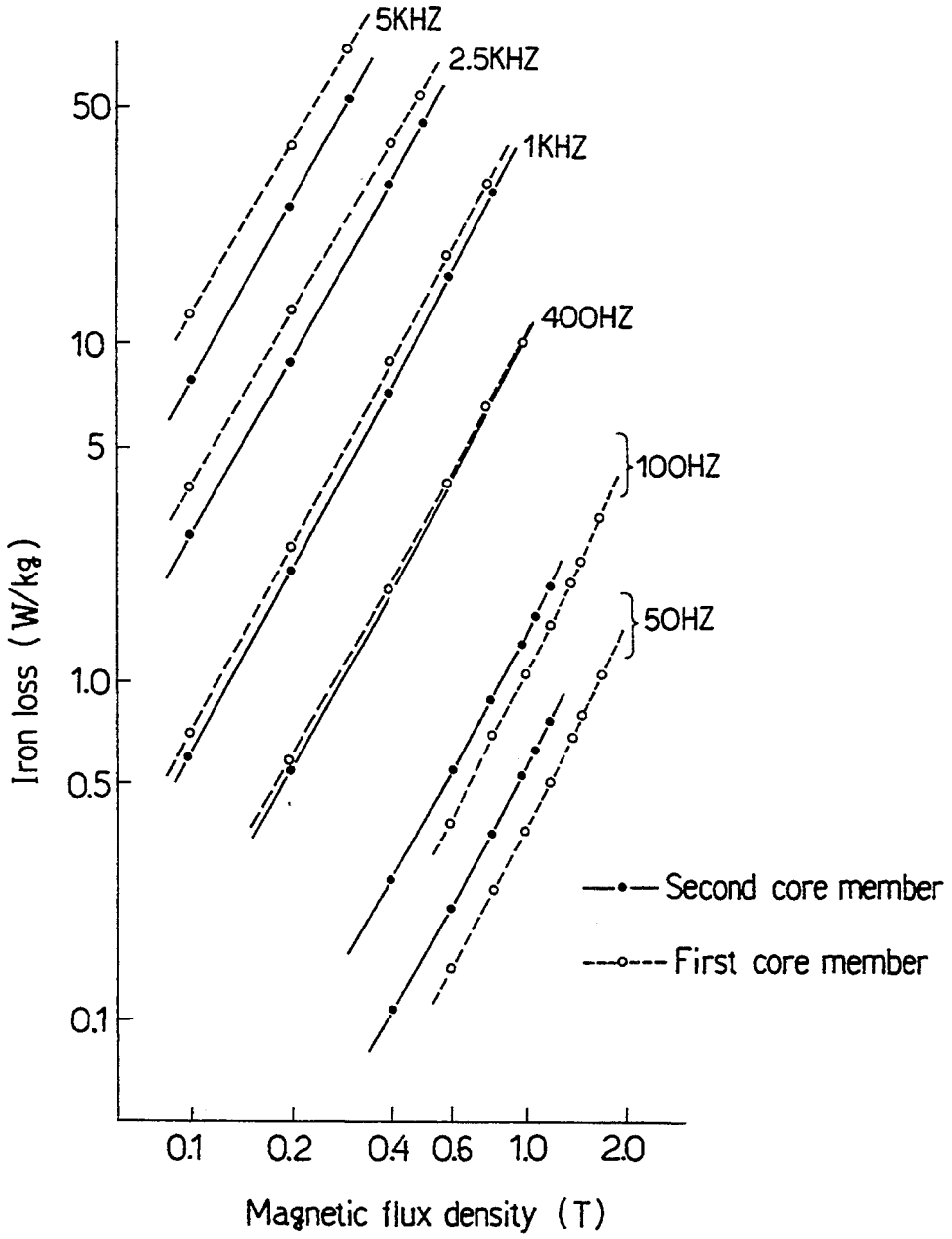
FIG. 5 is a graph of the iron loss characteristic of the transformer core.
Figure 6:
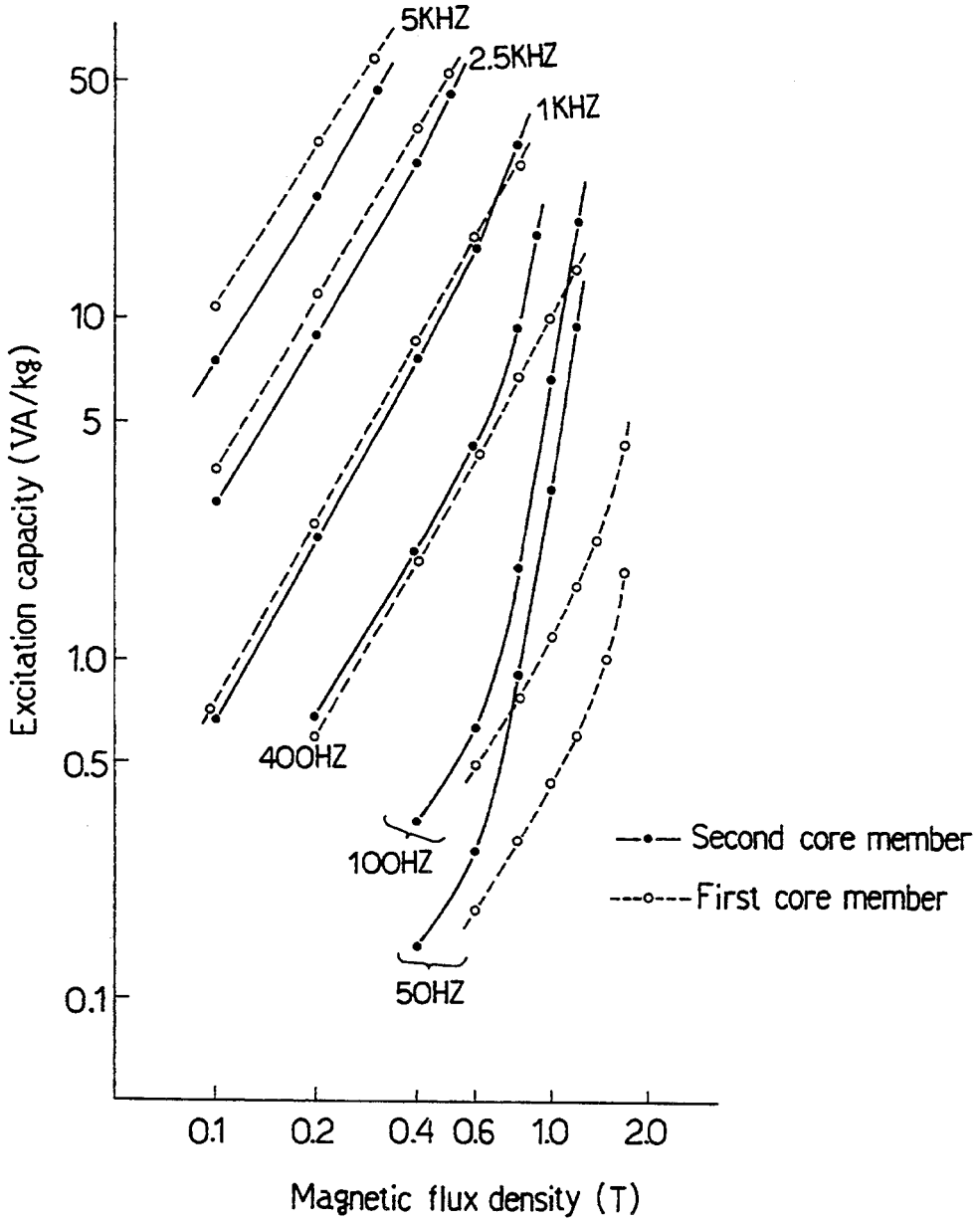
FIG. 6 is a graph of the excitation capacity characteristic of the transformer core.
Figure 7:
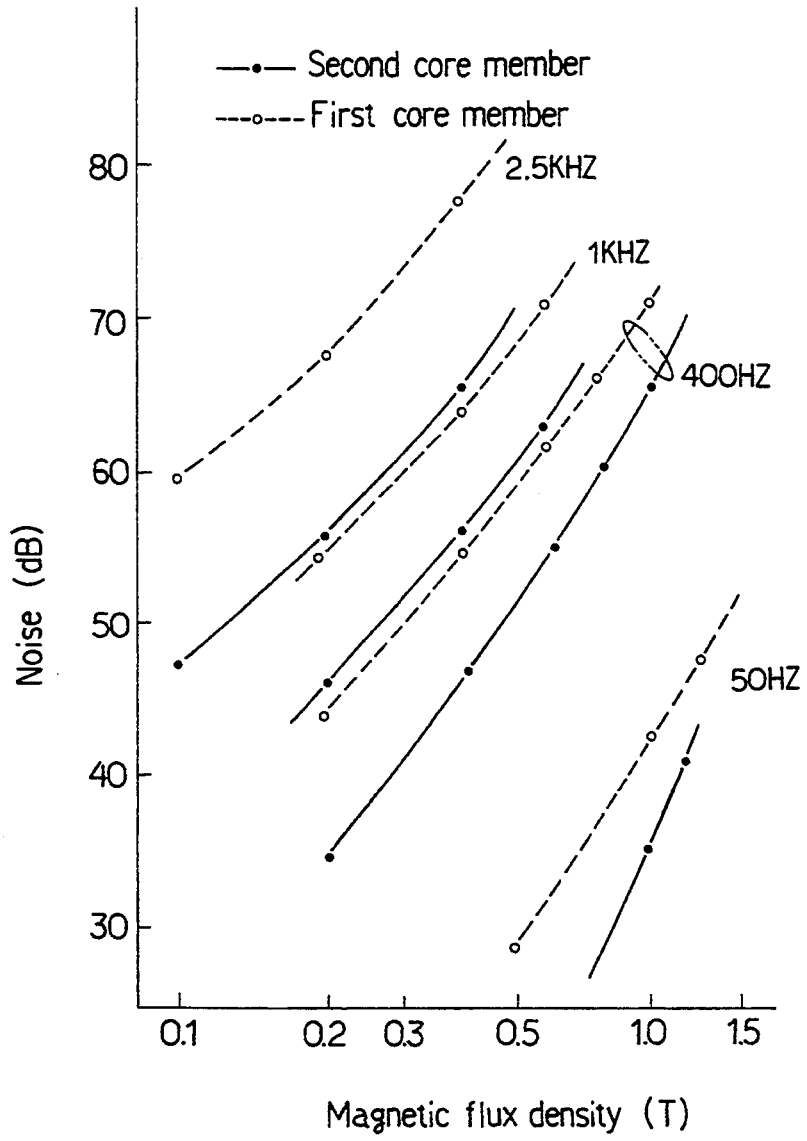
FIG. 7 is a graph of the noise characteristic of the transformer core.
Figure 11:
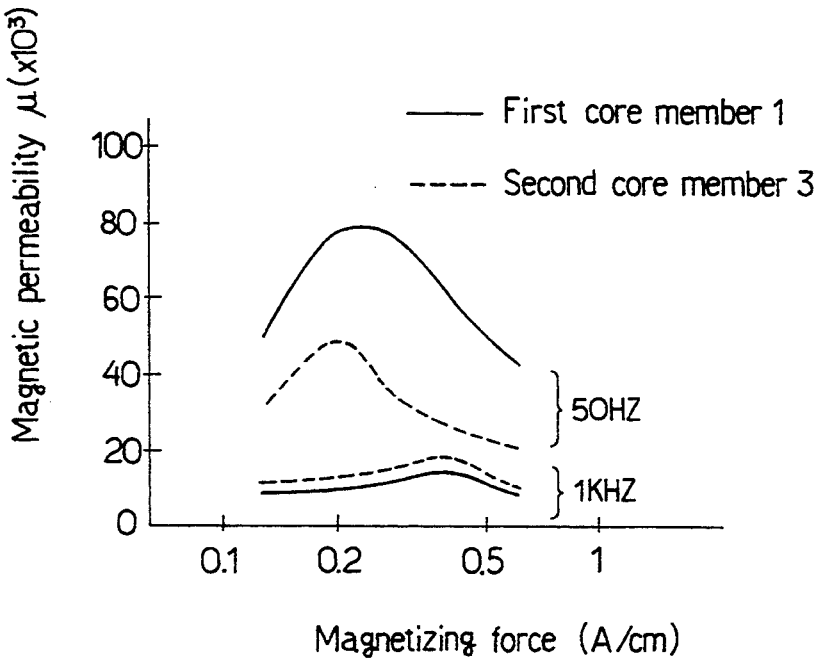
FIG. 11 is a graph of the magnetic permeability characteristics of first and second core members of the transformer core.
Figure 12:
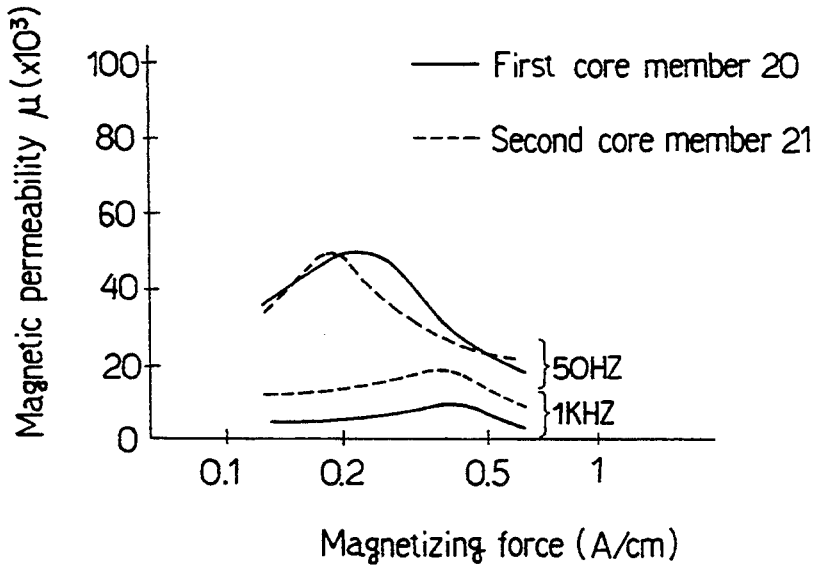
FIG. 12 is a graph of the magnetic permeability characteristics of first and second core members of the transformer core having a construction different from that of the core in FIG. 11.

FIG. 11 shows magnetic permeability characteristics of the first and second core members 1, 3 each having no gaps at the junctions as shown in FIG. 1. FIG. 12 shows magnetic permeability characteristics of the first core member 20 having gaps at the respective Junctions and the second core member 21 having no gaps at the junctions as shown in FIG. 9. As obvious from comparison of FIGS. 11 and 12, the difference of the magnetic permeability between the first and second core members is smaller in the core assembly 22 in FIG. 9 in the commercial frequency range than in the core assembly 5 in FIG. 5.

TABLE 2

| Frequency (Hz) | Magnetic flux distribution ratio (operating magnetic flux 0.6 T) Core assembly 5 Second core member 3 | Core assembly 5 First core member 1 | Core assembly 22 Second core member 21 | Core assembly 22 First core member 20 |
|---|---|---|---|---|
| 50 | 20% | 71% | 36% | 64% |
| 400 | 46 | 54 | 52 | 48 |
| 1,000 | 53 | 47 | 58 | 42 |
| 2,500 | 60 | 40 | 68 | 32 |

TABLE 2 shows ratios of an amount of magnetic flux passing through each of the above-described first and second core members when the amount of magnetic flux passing through each of the first and second core members in the commercial frequency range is 100%. As understood from TABLE 2, the rate at which the magnetic flux is diverted to the second core member comprising the high content silicon steel sheets is higher in the core assembly 22 wherein the magnetic resistance at each junction of the steel sheet ends is increase more than in the other core assembly 5. Consequently, the second core member 21 can be used as a core forming a magnetic circuit in the commercial frequency range and the noise can be reduced as an amount of the low frequency magnetic flux passing through the first core having a high level of magnetostriction.

The magnetic powder may or may not be contained in the adhesive when the adjustment of the magnetic resistance is not necessary.

Figure 13:
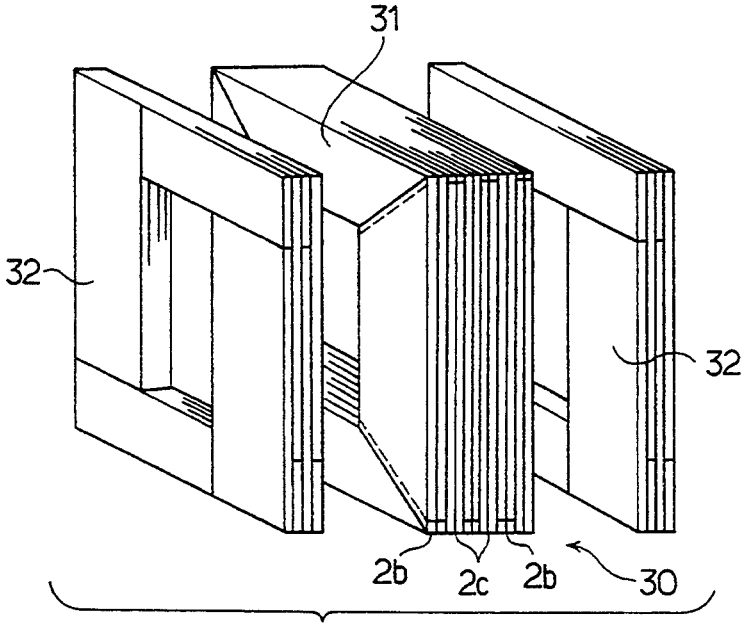
FIG. 13 is an exploded perspective view of a transformer core of a fourth embodiment.
Figure 14:
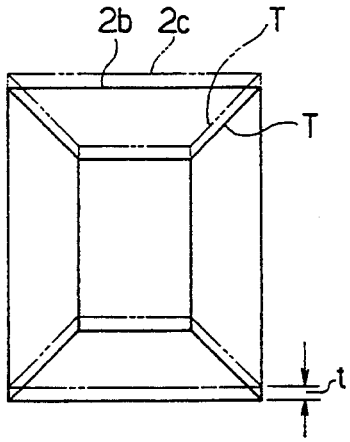
FIG. 14 is a top plan view of steel sheets forming the first core member of the core in FIG. 13 for explaining disposition of the steel sheets.
Figure 15:
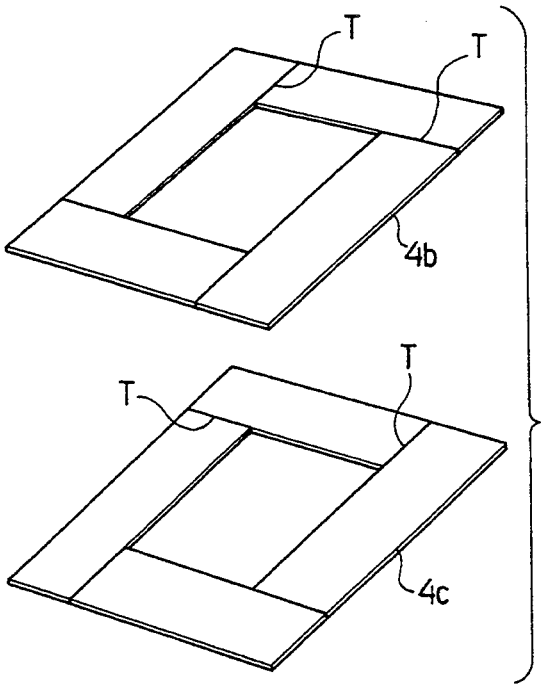
FIG. 15 is a perspective view of the steel sheets forming the second core member of the core in FIG. 13 for explaining disposition of the steel sheets.

FIGS. 13 to 15 illustrate a fourth embodiment of the invention. The core assembly 30 comprises the first core member 31 formed by laminating the grain oriented 3% silicon steel sheets 2 as shown in FIG. 3 and the second core member 32 formed by laminating the non-oriented 6.5% silicon steel sheets 4 as shown in FIG. 4. In this embodiment, after the unit sheet **2*b* shown by a solid line in FIG. 14 is formed by laminating a predetermined number of steel sheets 2, another unit sheet 2*c* shown by dotted line is formed on the unit sheet 2*a* by laminating the predetermined number of steel sheets 2. The following unit sheet 2*c* is displaced by a preselected length t in one direction relative to the preceding unit sheet 2*b*. This displacement is repeated to thereby obtain the first core member with predetermined dimensions. As the result of such a formation as described above, the butted portions T of the steel sheets in each unit sheet takes a position different from each other such that the butted portions T of the steel sheets in each unit sheet are not adjacent to each other in the direction of lamination of the steel sheets. The preceding unit sheet 2*b* and following unit sheet 2*c* each formed by laminating a predetermined number of steel sheets 4** are stacked together so that the butted portions T of both unit sheets take the same position and are not adjacent to each other in the direction of lamination of the steel sheets.

In the case of the wound core having the construction as described above, it is known in the art that the value of the magnetic resistance is influenced by the presence of the gaps at the butted portions T and the overall magnetic resistance of the core is increased with increase in the number of steel sheets having the butted portions T taking the same position and adjacent in the direction of lamination. In the embodiment, the number of steel sheets in each unit sheet of the first core member 31 is larger than that of the second core member 32 so that the magnetic resistance of the first core member 31 is expected to be increased as compared with that of the second core member 32. In this embodiment, each one unit sheet of the first core member 31 is composed of four laminated steel sheets 2 and each one unit sheet of the second core member 32 is composed of two laminated steel sheets 4. The cross sectional area ratio, $S_1/S_2$, is 50%.

TABLE 3

| Frequency (Hz) | Magnetic flux distribution ratio (operating magnetic flux 0.6 T) A sample core assembly Second core member A | A sample core assembly First core member B | Core assembly 30 Second core member 32 | Core assembly 30 First core member 31 |
|---|---|---|---|---|
| 50 | 29% | 71% | 36% | 64% |
| 400 | 46 | 54 | 52 | 48 |
| 1,000 | 53 | 47 | 58 | 42 |
| 2,500 | 60 | 40 | 68 | 32 |

TABLE 3 shows ratios of an amount of magnetic flux passing through each of the above-described first and second core members when the amount of magnetic flux passing through each of the first and second core members in the commercial frequency range is 100%. A sample core assembly in TABLE 3 has the same construction as the core assembly 30 in the embodiment except for the number of steel sheets composing each unit sheet. Each one unit sheet of each of first and second core members A and B in the sample core assembly is composed of two steel sheets. It is understood from TABLE 3 that the difference of the amount of magnetic flux between the first and second core members is smaller in the core assembly 30 of the embodiment than in the sample core assembly. Since the number of steel sheets composing each unit sheet **2*b*, 2*c* is larger in the first core member 31 than in the second core member 32, the magnetic resistance in the first core member 31 is increased, resulting in increase in the number of magnetic fluxes passing through the second core member 32**. The same effect can be achieved in this embodiment as in the third embodiment.

The foregoing disclosure and drawings are merely illustrative of the principles of the present invention and are not to be interpreted in a limiting sense. The only limitation is to be determined from the scope of the appended claims.

We claim:

1. A distorted wave AC transformer core comprising a first core member formed by laminating a number of cold-rolled grain-oriented 3% silicon steel sheets and a pair of second core members disposed at opposite sides of the first core member in a direction that a lamination of the grain-oriented silicon steel sheets of the first core member extends, each second core member being formed by laminating a number of 6.5% silicon steel sheets, each second core member having magnetostriction lower than the first core member, the pair of second core members having an overall sectional area, taken in a direction perpendicular to a direction in which magnetic fluxes pass through the second core members, in the range of 10 to 50% of an overall sectional area of the first and second core members.

* * * * *